US008959968B2

(12) United States Patent
Böse et al.

(10) Patent No.: US 8,959,968 B2
(45) Date of Patent: Feb. 24, 2015

(54) MAGNETORHEOLOGICAL LUBRICANT FOR METAL FORMING PROCESSES

(75) Inventors: Holger Böse, Würzburg (DE); Christoph Janssen, Würzburg (DE); Johannes Ehrlich, Wiesenbronn (DE); Piet Wölcken, Bremen (DE)

(73) Assignee: EADS Deutschland GmbH, Ottobrunn (DE)

( * ) Notice: Subject to any disclaimer, the term of this patent is extended or adjusted under 35 U.S.C. 154(b) by 1434 days.

(21) Appl. No.: 12/527,858

(22) PCT Filed: Jun. 4, 2008

(86) PCT No.: PCT/EP2008/056948

§ 371 (c)(1),
(2), (4) Date: Feb. 7, 2011

(87) PCT Pub. No.: WO2008/148826

PCT Pub. Date: Dec. 11, 2008

(65) Prior Publication Data

US 2011/0113845 A1 May 19, 2011

(30) Foreign Application Priority Data

Jun. 8, 2007 (DE) ..... 10 2007 026 592

(51) Int. Cl.

| | |
|---|---|
| ***B21B 45/02*** | (2006.01) |
| ***B21D 22/20*** | (2006.01) |
| ***B21C 9/00*** | (2006.01) |
| ***B21C 23/00*** | (2006.01) |

(Continued)

(52) U.S. Cl.

CPC ..... *B21D 22/201* (2013.01); *B21C 9/00* (2013.01); *B21C 23/00* (2013.01); *B21D 37/18* (2013.01); *B21J 3/00* (2013.01); *C10M 171/001* (2013.01); *H01F 1/447* (2013.01); *C10N 2240/402* (2013.01); *Y10S 72/707* (2013.01)

USPC ..... 72/43; 72/430; 72/707

(58) Field of Classification Search

USPC ..... 72/41, 42, 43, 430, 707

See application file for complete search history.

(56) References Cited

U.S. PATENT DOCUMENTS

| | | | |
|---|---|---|---|
| 3,756,051 | A | 9/1973 | Rebsamen et al. |
| 5,480,573 | A | 1/1996 | Durfee et al. |

(Continued)

FOREIGN PATENT DOCUMENTS

| | | | |
|---|---|---|---|
| DE | 693 11 241 | T2 | 1/1998 |
| DE | 101 35 488 | A1 | 4/2003 |

(Continued)

OTHER PUBLICATIONS

Theo Mang, "Die Schmierung in der Metallbearbeitung" ("Lubrication in metal working"), book, 1983, pp. 243-256, ISBN 3-8023-0682-1, Vogel-Buchverlag, Germany.

(Continued)

*Primary Examiner* — Teresa M Ekiert
(74) *Attorney, Agent, or Firm* — Global IP Counselors, LLP

(57) ABSTRACT

A forming method includes using at least one forming tool to form a material of a workpiece and using a lubricant between the material and the at least one forming tool. The lubricant has a viscosity that is modifiable by applying or varying a field.

15 Claims, 2 Drawing Sheets

(51) Int. Cl.

| | |
|---|---|
| ***B21D 37/18*** | (2006.01) |
| ***B21J 3/00*** | (2006.01) |
| ***C10M 171/00*** | (2006.01) |
| ***H01F 1/44*** | (2006.01) |

(56) References Cited

U.S. PATENT DOCUMENTS

| | | | | |
|---|---|---|---|---|
| 6,106,380 | A | 8/2000 | Jacobs et al. | |
| 6,503,414 | B1 | 1/2003 | Kordonsky et al. | |
| 2004/0148997 | A1 * | 8/2004 | Amino et al. | 72/297 |

FOREIGN PATENT DOCUMENTS

| | | | |
|---|---|---|---|
| DE | 102 31 430 | A1 | 2/2004 |
| DE | 102 48 329 | A1 | 4/2004 |
| DE | 103 17 880 | B3 | 10/2004 |
| DE | 10 2004 055 415 | A1 | 5/2006 |
| DE | 10 2005 024 378 | A1 | 11/2006 |
| EP | 0 317 186 | A2 | 5/1989 |
| EP | 0 317 186 | A3 | 5/1989 |
| JP | 1-293925 | A | 11/1989 |

OTHER PUBLICATIONS

"Magnetorheological fluids for adaptive engine mounts", Fraunhofer ISC Annual Report 2004, p. 34-35; Fraunhofer ISC, Germany.

"3 D-Bearbeiten: Flexibles Umformen von Feinblech ohne Gegenform", Fraunhofer-Institut für Produktionstechnik and Automatisierung—Robotersysteme; R+R 05.04/10.05, Oct. 2005, Germany.

"Hämmern ins Bodenlose", Interaktiv—Fraunhofer IPA, No. 1.2004, pp. 14-15, Germany.

* cited by examiner

MAGNETORHEOLOGICAL LUBRICANT FOR METAL FORMING PROCESSES

BACKGROUND OF THE INVENTION

1. Field of the Invention

The invention relates to a forming method in which a material of a workpiece is formed by means of at least one forming tool, wherein a lubricant is used between the material and the at least one forming tool. The invention also relates to a lubricant to be used in such a method and an apparatus for carrying out such a method.

2. Background Information

Such a method and a forming apparatus used for carrying out the same are known from Theo Mang's book "Die Schmierung in der Metallbearbeitung" ("Lubrication in metal working"), ISBN 3-8023-0682. It is thus known to use lubricants in metal forming methods, such as deep drawing metal sheets. By these means, the coefficient of friction between the at least one forming tool and the material is varied to influence the forming method and its result.

SUMMARY OF THE INVENTION

It is the object of the present invention to improve a forming method of the initially mentioned type in such a way that a greater variety of shapes is achievable with improved quality.

This object is achieved by a forming method according to a first aspect of the present invention.

A lubricant able to be used in such a forming method, and an apparatus for carrying out such a forming method are the subject matter of the other aspects of the present invention.

Advantageous embodiments of the invention are the subject matter of still other aspects of the present invention.

In a forming method according to the present invention, a material of a workpiece is formed by means of at least one forming tool. For this purpose, a lubricant is introduced between the material and the at least one forming tool having a viscosity which is modifiable by applying or varying a field.

The lubricant has electro-rheological and/or magneto-rheological properties, i.e., its viscosity is modified, for example, by the application of an electric or magnetic field.

In a preferred embodiment, the forming method is a metal forming method, wherein the material is a metal. The invention is particularly suitable for cold forming methods in which the metal is formed without the additional application of heat.

A magneto-rheological fluid (MRF) is particularly preferred as a lubricant.

Magneto-rheological fluids are known, for example, from "Magnetorheological fluids for adaptive engine mounts", Fraunhofer ISC Annual Report 2004, p. 24, for the application in adaptive engine mounts for vibration damping of engine vibrations in vehicles. The present invention refers to a totally different technical field, namely to a forming method.

The forming method according to the present invention, in a preferred embodiment, is a metal sheet forming method. For example, the lubricant having a viscosity able to be influenced by a field is used in a forming method. A method is particularly preferred in which there are locally strongly varying requirements as to the coefficient of friction, such as an incremental sheet forming (ISF) process. Incremental sheet forming processes which can be further developed according to the present invention are described in the publications "3 D-Bearbeiten: Flexibles Umformen von Feinblech ohne Gegenform" ("3D-working: flexible forming of sheets without counter mold"); Fraunhofer-Institut für Produktionstechnik and Automatisierung-Robotersysteme; R+R 05.04/10.05, October 2005, and in the publication "Hämmern ins Bodenlose" ("Hammering into the void") in "Interaktiv-Fraunhofer IPA", No. 1.2004, pp. 14 and 15, and in DE 102 31 430 A1, DE 103 17 880 B3 and DE 10 2005 024 378 A1. Herein a forming tool is traversed along a predetermined path across the workpiece to be worked so that sections of the workpiece are incrementally formed until its ultimate shape is reached.

The properties of the variable viscosity can also be used, for example, to remove the lubricant after the forming process more easily, wherein the viscosity is modified by applying or varying a field to be able to remove the lubricant more easily after the forming process.

However, particular advantages result from the application of a lubricant with a viscosity able to be influenced by a field during the forming process. In metal forming, and in particular in incremental forming processes, it is often desirable to locally influence the coefficient of friction to optimize the process. In an advantageous embodiment of the invention, by varying the viscosity of the lubricant, the coefficient of friction between the workpiece and the forming tool can be selectively, and in particular, also locally varied. Therefore, a particularly preferred embodiment of the invention is characterized by applying to the lubricant, and/or varying on the lubricant, an electric or magnetic field influencing the viscosity of the lubricant for influencing the forming process.

By applying a field, such as a magnetic field, in the use of a magneto-rheological fluid, the viscosity of the fluid used can be varied due to the stiffness able to be influenced by the field. The field can be a single field, such as a locally differentiated field, or a plurality of locally defined and/or overlapping fields can be used. The field, or one of a plurality of fields, can be generated externally to the at least one forming tool. As a result, the geometry of the forming tool is not a limiting factor. For example, superconducting magnets can also be used for particularly strong magnetic fields.

On the other hand, with externally generated fields, it may be difficult to transfer the field strength and field orientation to the forming tool in a suitable manner. For example, both electric and magnetic fields are influenced by forming tools of metal or other metal parts of a forming apparatus. In an advantageous embodiment of the invention, it is thus provided that the or at least one of a plurality of fields is generated in or on the forming tools. An external field can also be overlapped with a field generated on the fording tools. It goes without saying that other approaches and combinations are also conceivable. Fields variable in time and/or place are also conceivable.

In an advantageous embodiment, the at least one field is conducted to the lubricant through the at least one forming tool and/or the material. This is advantageous, in particular, with forming tools of metal or with metals to be shaped, since the electric or magnetic properties of the metal materials are suitable for conducting.

For the selective process control it is preferred if different fields and/or different field strengths and/or field orientations are applied in different places and/or at different times.

The spatial distribution and/or the flux density of the field can be controlled by the shape of the at least one forming tool.

The lubricant according to the present invention for use in a forming method for forming a workpiece by means of at least one forming tool is distinguished in that it is a fluid having a viscosity variable by applying a field. By these means the viscosity can be selectively and controllably adjusted during, prior to or after the forming process by applying or varying a field, for example, to locally modify and/or adjust the coefficient of friction in the forming process and/or to facilitate the application, distribution or removal of the lubricant on or from the material or forming tool.

The lubricant is preferably an electro-rheological and/or magneto-rheological fluid which contains polarizable particles dispersed in a carrier fluid. By suitably choosing the carrier fluid and the particles, the properties of the lubricant can be adjusted. For example, the range of viscosity to be adjusted can be chosen by selecting carrier fluids of higher or lower viscosity and by selecting the particle size or particle shape. The carrier fluid is, for example, a forming oil suitable for use in a metal forming process, wherein particles polarizable by the corresponding field are dispersed. In particular, oils or other lubricants are used as a base which have lower viscosity in comparison with forming oils hitherto used in conventional metal forming methods.

The apparatus according to the present invention for forming a material of a workpiece with at least one forming tool using a lubricant is distinguished by a field generating means for generating a field influencing the viscosity of an electro-rheological and/or magneto-rheological lubricant. In the preferred use of a magneto-rheological fluid—referred to as a MRF in the following—for forming metals, the apparatus preferably has a magnetic field generating means for generating a magnetic field with which the viscosity of the MRF can be adjusted.

The apparatus is preferably configured as a metal sheet forming apparatus for cold forming of metal sheets, wherein forming tools are provided in a similar manner to well-known corresponding metal sheet forming tools. For example, a deep-drawing apparatus or IBU apparatus is provided configured for forming a metal sheet. However, any other cold forming process and at least some warm forming processes can also take advantage of the use of the present invention. The present invention can thus also be used according to other embodiments for extrusion methods and extrusion apparatuses, wire drawing methods and wire drawing apparatuses, rolling or pressing methods and apparatuses and/or to forging processes and apparatuses, such as tumble forging.

In contrast to well-known corresponding metal working apparatuses, in a preferred embodiment of the invention, the at least one forming tool has at least one permanent magnet or electric magnet.

By incorporating electronic magnets in the forming tool, a field can be designed, created and/or generated which leads to an optimum contacting state between the tool and the workpiece on any predetermined point in the contact zone.

Advantages of the invention and/or its advantageous embodiments are, in particular:

- existing limitations and limits for forming can be significantly overcome; this applies, in particular, to processing forces (forming pressure), boundary form change and surface quality;
- hitherto unformable components can now be formed;
- easier removal of lubricant, if any;
- improved process control and
- improved quality management.

BRIEF DESCRIPTION OF THE DRAWINGS

An embodiment of the invention will described in more detail in the following with reference to the accompanying drawings, in which.

DETAILED DESCRIPTION OF THE PREFERRED EMBODIMENTS

Figure 1:
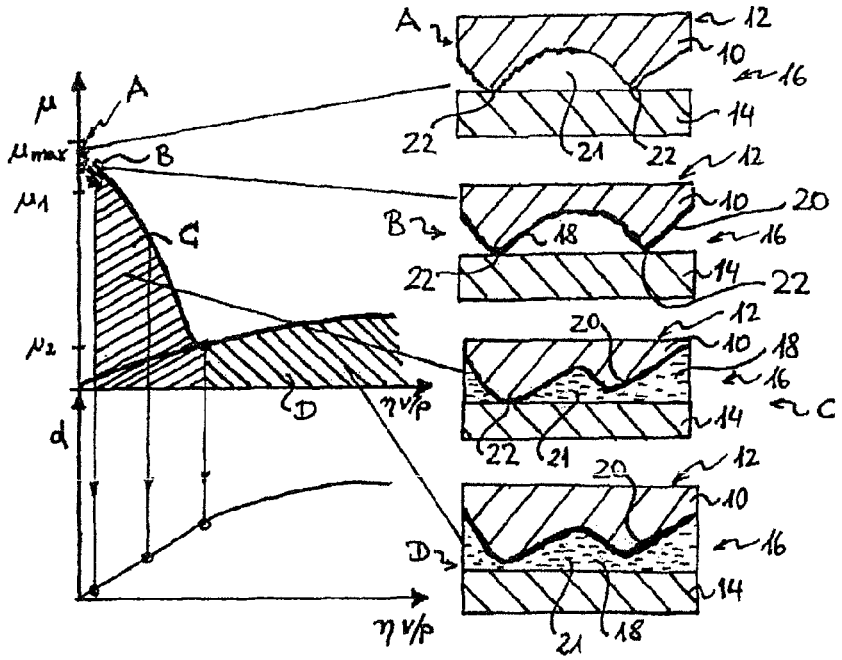
FIG. 1 is a graphical diagram, given for purposes of explanation, for illustrating the influence of a lubricant and in particular its viscosity on metal sheet forming methods.

FIG. 1 shows possible frictional states in a metal forming method wherein a metal material 10 of a workpiece 12 is formed by means of forming tool 14, shown in a so-called Stribeck diagram. The diagram is shown in the left half of the figure. The right half of FIG. 1 shows a contact zone 16 between forming tool 14 and workpiece 12 in various areas of the diagram.

In the Stribeck diagram, various film thicknesses d of a lubricant 18 and the coefficient of friction $\mu$ is indicated as a function of the factor $\eta$ v/p, wherein $\eta$ is the viscosity of lubricant 18, v is the relative velocity of the partners in friction 12, 14 and p is the normal pressure in contact zone 16.

A first area A characterizes a forming behavior without lubricant 18. Pure dry friction is present. The coefficient of friction $\mu$ is at a maximum $\mu=\mu_{max}$. In a second area B, boundary layers 20 of the two partners in friction 12, 14 are wetted with lubricant 18. Lubricant 18, sparsely applied, initially deposits and adheres on the frictional surfaces. Boundary friction occurs, wherein frictional surfaces rub against each other with the adhesion of lubricant. The coefficient of friction $\mu$ is slightly lower, $\mu_1 \leq \mu < \mu_{max}$, wherein $\mu_1$ is a coefficient of friction at the boundary between boundary friction and mixed friction. In a third area C, lubricant 18 is in spaces 21 between partners in friction 12, 14, wherein there are still more or fewer contact areas 22, in which the boundary layers 20 are still in contact. The coefficient of friction $\mu$ is lower still, $\mu_2 \leq \mu < \mu_1$, wherein $\mu_2$ is the coefficient of friction at the boundary between mixed friction and purely hydro-dynamic friction. In a fourth area D, the film thickness d is sufficient to eliminate any contact areas 22. Lubricant 18 is everywhere between the boundary layers 20. Purely hydro-dynamic friction is present.

The coefficient of friction $\mu$ can be optimized in area C of mixed friction and, in particular, in area D of purely hydro-dynamic friction by viscosity control. Viscosity can also be used to adjust thrust tension $\tau$ in contact zone 16, wherein $\tau=\eta dv/dt$, wherein dv/dt is the derivative of v with respect to time.

In metal forming and, in particular, in incremental forming processes, it is desirable for optimizing the process to locally influence the coefficient of friction to selectively influence the forming method at a particular place. This can be done, as explained above, by influencing the viscosity of a lubricant 18 used in metal forming. To this end, in the forming methods explained in more detail in the following, a fluid is used which has a viscosity variable by applying or varying a field. In the exemplary embodiments, this is a magneto-rheological fluid, referred to as MRF in short in the following.

An MRF is an intelligent liquid material, the rheological properties of which can be sensibly, mostly drastically, controlled, reversibly in most cases, by a magnetic field. An MRF becomes gel-like in a magnetic field, for example, and reverts to the liquid state after switching off the magnetic field. MRFs are analogous to electro-rheological fluids—ERF—which are usable in an alternative embodiment, where it is possible, due to the materials, to effectively apply an electric field. An MRF is produced by a dispersion of magnetically polarizable particles in a carrier fluid.

A first exemplary embodiment will be explained in more detail in the following with reference to the illustration in FIG. 2, for improving a sheet forming process by the use of magneto-rheological fluids taking a deep-drawing method as an example.

Figure 2:
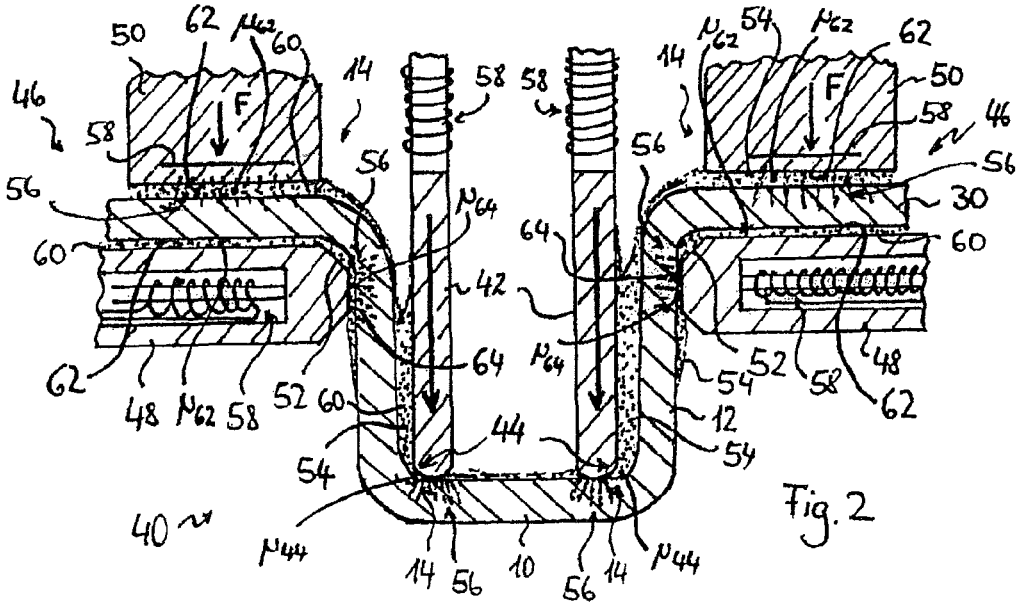
FIG. 2 is a schematic illustration of a first embodiment of a forming apparatus for metal working using, as an example, a deep-drawing apparatus for deep drawing of a sheet.

It is shown in FIGS. 2 to 5 how a metal sheet 30 is brought into the desired three-dimensional shape with the aid of one or more forming tools 14 by means of a forming process, e.g., a drawing process in FIG. 2.

In FIG. 2, a forming apparatus 40 is shown for carrying out a deep-drawing method. Forming apparatus 40 of the present example has a punch 42 with edge areas 44 serving as forming tools 14. For this purpose, punch 42 is moveable between and relative to two clamps 46. Clamps 46 have fixed jaws 48 and moveable jaws 50 pressable toward fixed jaws 48 for clamping the metal sheet 30 at a predefined force F. Jaws 48, 50 serve as further forming tools 14. To this end, edges 52 of fixed jaws 48 are formed according to the desired shape. Between forming tools 14, 44, 48, 50 and metal sheet 30, there is a forming oil 54 which is to have a certain viscosity $\eta$.

By using a magneto-rheological fluid—MRF—60, the viscosity $\eta$ of forming oil 54 is adjusted as required in each situation by a magnetic field 56 to improve the forming process.

In the forming method presented here, magnetic field 56 is generated externally via magnetic field generating means (not shown) comprising, for example superconducting magnets, and/or in forming tools 14, 44, 48, 50 and conducted through the working surfaces of forming tools 14, 44, 48, 50 and through metal sheet 30.

For this purpose, forming tools 14, 44, 48, 50 have electronic magnets 58, for example, electronically controllable electric magnets. Magnetic field 56 can vary the stiffness of MRF 60. Due to the shape of the corresponding forming tool 14, 44, 48, 50, the spatial distribution and the magnetic flux density of magnetic field 56 can be predetermined.

Magnetic field 56 is adjusted by a control (not shown in any more detail) in such a manner that a viscosity variable over time, and therefore a coefficient of friction $\mu_{62}$ variable over time, is adjusted on clamping surfaces 62 of jaws 48, 50, to hold tight the edge of metal sheet 30 or to enable additional material to flow depending on the forming progress. The magnetic field, and therefore the viscosity of MRF 60, is adjusted at the contact surfaces 64 by the control in such a way that a relatively low coefficient of friction $\mu_{64}$ is present at the contact surface 64. At the edge areas 44 of punch 42, magnetic field 56 is adjusted in such a way that a viscosity of MRF 60 is adjusted which leads to a high coefficient of friction $\mu_{44}$.

MRF 60 is adapted by its composition to a desirably adjustable range of viscosity. For this purpose, the size distribution of the magnetizable particles in MRF 60 and the carrier fluid are optimized. Forming oil 54 is used as the carrier fluid, wherein a particularly low-viscosity forming oil 54 is chosen for this task.

Although the forming method has been described with reference to an example of a sheet drawing method, the application of a fluid having a viscosity controllable by a field is not limited to such sheet drawing methods but can be applied also to other metal working methods. It can be transferred to corresponding forming methods for forming other materials by means of forming tools which can be influenced by different viscosities of the lubricants or separating agents used.

Particular advantages are offered by the application of a fluid with a viscosity controllable by a field in an incremental forming method, in particular in an incremental sheet forming (ISF) method, as described and claimed, for example, in the publications "3 D-Bearbeiten: Flexibles Umformen von Feinblech ohne Gegenform" ("3D-working: flexible forming of sheets without counter mold"); Fraunhofer-Institut für Produktionstechnik and Automatisierung-Robotersysteme; R+R 05.04/10.05, October 2005, and in the publication "Hämmern ins Bodenlose" ("Hammering into the void") in "Interaktiv-Fraunhofer IPA", No. 1.2004, pp. 14 and 15, and in DE 102 31 430 A1, DE 103 17 880 B3 or DE 10 2005 024 378 A1.

Figure 3:
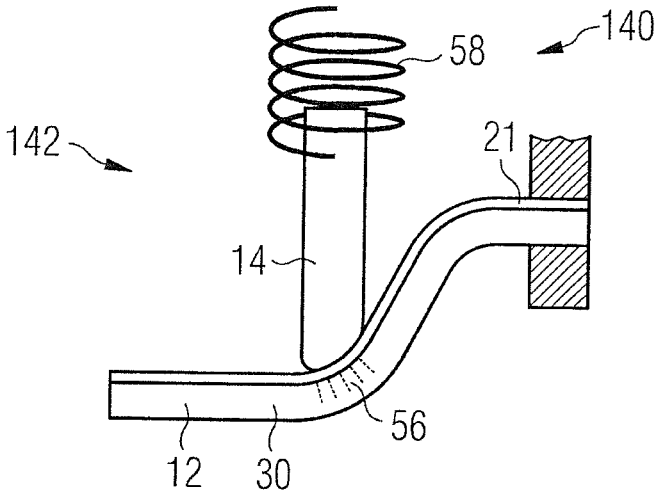
FIG. 3 is a schematic illustration of a second embodiment of a forming apparatus for metal working using, as an example, an apparatus for incremental sheet forming.

FIG. 3 shows a forming apparatus 140 suitable for carrying out such an incremental sheet forming method, which has a basic structure as described in any one of the above-mentioned publications. For a more detailed description of the structure, and the functioning of such forming apparatuses 140, explicit reference is made to the above-mentioned publications. Unlike the prior-art foil ling apparatuses, a forming tool 142 of forming apparatus 140 has electronic magnet 58 in a similar manner as in the exemplary embodiment shown in FIG. 2.

Figure 4:
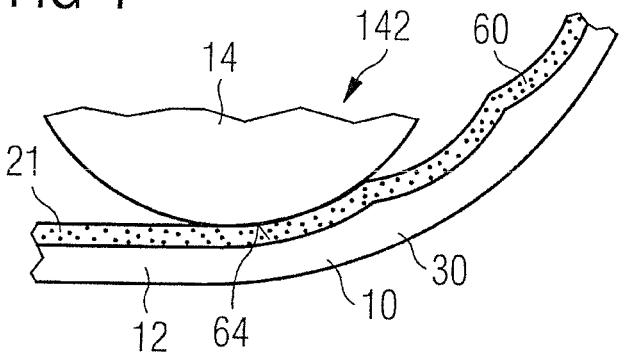
FIG. 4 shows a detail of the apparatus of FIG. 3.

As shown in more detail in FIG. 4, magneto-rheological fluid 60 is used between metal sheet 30 and forming tool 142 as in the example explained with reference to FIG. 2, having a viscosity $\eta$ variable by means of magnetic field 56 generated by magnet 58.

Figure 5:
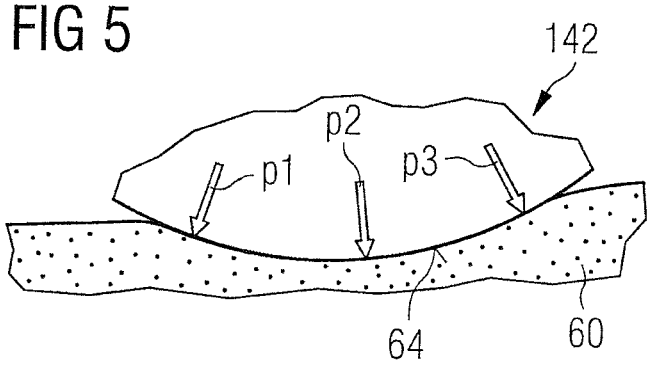
FIG. 5 is an enlarged view of an area of the workpiece currently to be worked by the apparatus of FIG. 3.

Different compression strengths $p_1$, $p_2$, $p_3$ can thus be generated, for example, in different areas of contact surface 64 between forming tool 142 and metal sheet 30, as shown in FIG. 5. In this way, further possibilities of influencing the shape of the metal sheet are given during the individual forming steps of the forming tool 142 moving along a predetermined movement path for incremental forming.

Although the use of a magneto-rheological fluid has been described in the above-mentioned exemplary embodiments, the invention is not limited to the use of magneto-rheological fluids. An electro-rheological fluid could also be used, for example, having a viscosity variable by applying an electric field. To this end, a forming tool 14, 44, 48, 50, 142 of the exemplary embodiments described could be configured, for example, as an electrode for applying an electric field.

What is claimed is:

1. A forming method comprising:

forming a material of a workpiece by at least one forming tool;

using a lubricant between the material and the at least one forming tool, the lubricant having a viscosity being modifiable by applying or varying a field; and modifying the viscosity of the lubricant between the material and the at least one forming tool by varying the field during the forming of the material while the at least one forming tool is influencing the shape of the material.

2. The forming method according to claim 1, wherein the material is a metal, and is formed without the supply of additional heat.

3. The forming method according to claim 2, wherein the forming method is a deep-drawing, extruding, wire-drawing, rolling, pressing, forging, or tumble-forging method.

4. The forming method according to claim 2, wherein a metal sheet is formed.

5. The forming method according to claim 4, wherein the metal sheet is deep-drawn.

6. The forming method according to claim 1, wherein the forming method is an incremental sheet forming method or an incremental forming method; and the modifying includes modifying the viscosity of the lubricant between the material and the at least one forming tool by varying the field at different increments during the incremental forming of the material.

7. The forming method according to claim 1, wherein the least one field influencing is applied or varied to influence the viscosity of the lubricant to at least a part of the lubricant.

8. The forming method according to claim 7, wherein by applying and/or varying the field, the coefficient of friction of the material is locally and/or generally influenced on the at least one forming tool.

9. The forming method according to claim 7, wherein the at least one of a plurality of fields is generated external to the at least one forming tool.

10. The forming method according to claim 7, wherein the at least one of a plurality of fields is generated in or on the forming tools.

11. The forming method according to claim 7, wherein the at least one field is conducted through the at least one forming tool and/or the material to the lubricant.

12. The forming method according to claim 7, wherein different fields and/or different field strengths are applied in different places and/or at different times.

13. The forming method according to claim 7, wherein the spatial distribution and/or the flux density of the field is determined by the shape of the at least one forming tool.

14. The forming method according to claim 1, wherein an electro-rheological fluid and/or a magneto-rheological fluid is used.

15. The forming method according to claim 14, wherein an electric or/and a magnetic field is applied.

* * * * *